US010072371B2

(12) United States Patent
Bae

(10) Patent No.: US 10,072,371 B2
(45) Date of Patent: Sep. 11, 2018

(54) WASHING MACHINE

(71) Applicant: LG ELECTRONICS INC., Seoul (KR)

(72) Inventor: Suncheol Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/010,862

(22) Filed: Jan. 29, 2016

(65) Prior Publication Data

US 2016/0222568 A1 Aug. 4, 2016

(30) Foreign Application Priority Data

Jan. 30, 2015 (KR) ..... 10-2015-0015241

(51) Int. Cl.

| | |
|---|---|
| ***D06F 33/02*** | (2006.01) |
| ***D06F 33/00*** | (2006.01) |
| ***D06F 35/00*** | (2006.01) |
| ***D06F 39/08*** | (2006.01) |

(52) U.S. Cl.

CPC ..... *D06F 33/02* (2013.01); *D06F 33/00* (2013.01); *D06F 35/00* (2013.01); *D06F 39/087* (2013.01); *D06F 2212/02* (2013.01); *D06F 2214/00* (2013.01); *D06F 2220/00* (2013.01)

(58) Field of Classification Search

CPC ..... D06F 33/00; D06F 33/02; D06F 35/00; D06F 39/005; D06F 39/087; D06F 2212/02; D06F 2214/00; D06F 2220/00

See application file for complete search history.

(56) References Cited

U.S. PATENT DOCUMENTS

| | | | | |
|---|---|---|---|---|
| 5,634,227 | A | 6/1997 | Lim | |
| 5,644,936 | A * | 7/1997 | Yasutake | D06F 39/005 68/12.02 |
| 5,694,793 | A * | 12/1997 | Nishimura | D06F 39/005 68/12.27 |
| 6,934,592 | B2 * | 8/2005 | Hood | D06F 39/005 68/12.27 |
| 7,516,629 | B2 * | 4/2009 | Behrens | D06F 39/005 68/12.12 |
| 8,438,879 | B2 * | 5/2013 | Gokceimam | D06F 39/005 126/273 R |
| 8,490,440 | B2 * | 7/2013 | Aykroyd | D06F 33/02 68/12.12 |
| 9,003,317 | B2 * | 4/2015 | Beaudet | D06F 93/00 715/751 |

(Continued)

FOREIGN PATENT DOCUMENTS

| | | |
|---|---|---|
| CN | 101338508 A | 1/2009 |
| GB | 2316954 A | 3/1998 |

(Continued)

*Primary Examiner* — Joseph L Perrin
(74) *Attorney, Agent, or Firm* — Dentons US LLP

(57) ABSTRACT

Disclosed herein is a washing machine including a time setting unit configured to set an operation time, and a controller configured to control the laundry treatment operation so as to be terminated before expiration of the operating time by adjusting at least one of a level of water supplied to a washing tub to execute at least one of the wash and the rinse, a number of times of executing the rinse and an execution time of the spin-dry, according to the operation time set through the time setting unit.

13 Claims, 3 Drawing Sheets

(56) References Cited

U.S. PATENT DOCUMENTS

| | | | | |
|---|---|---|---|---|
| 9,091,010 | B2 * | 7/2015 | Luckman | D06F 33/02 |
| 2004/0107510 | A1 * | 6/2004 | Buckroyd | D06F 39/005 8/159 |
| 2004/0134238 | A1 * | 7/2004 | Buckroyd | D06F 39/005 68/12.23 |
| 2012/0012135 | A1 | 1/2012 | Hong et al. | |
| 2012/0084995 | A1 | 4/2012 | Vogel | |

FOREIGN PATENT DOCUMENTS

| | | | |
|---|---|---|---|
| GB | 2320587 | A | 6/1998 |
| JP | 07-039672 | A | 2/1995 |
| JP | 10-201983 | A | 8/1998 |
| JP | 2001-204986 | A | 7/2001 |
| KR | 10-2008-0057711 | A | 6/2008 |

* cited by examiner

WASHING MACHINE

CROSS-REFERENCE TO RELATED APPLICATION

This application claims priority under 35 U.S.C. § 119 to Korean Patent Application No. 10-2015-0015241, filed on Jan. 30, 2015 in the Korean Intellectual Property Office, the disclosure of which is incorporated herein by reference.

BACKGROUND OF THE INVENTION

1. Field of the Invention

The present invention relates to a washing machine.

2. Description of the Related Art

In general, a washing machine is an apparatus which washes laundry, such as clothes or bedclothes, using the emulsification action of detergent, a water current generated by a washing tub or a pulsator, or mechanical power of the pulsator.

Such a washing machine sequentially performs a wash in which a detergent is supplied to remove contaminants from laundry, a rinse in which the detergent is removed from the laundry, and a spin-dry in which water is removed from the laundry by rotating a washing tub containing the laundry at a high speed.

Conventionally, when driving of the washing machine is started according to various setting items input by a user through a control panel, an amount of laundry put into the washing tub (hereinafter, referred to as a "laundry amount") is sensed, a proper laundry treatment operation is set according to the sensed laundry amount, and an execution time of the laundry treatment operation is set. In the conventional washing machine, when the laundry treatment operation is set according to the laundry amount, it is difficult for a user to arbitrarily adjust the execution time of the laundry treatment operation.

SUMMARY OF THE INVENTION

An object of the present invention is to provide a washing machine in which a laundry treatment operation including a wash, a rinse and a spin-dry is terminated within a time set by a user.

Another object of the present invention is to provide a washing machine in which various properties necessary to execute a laundry treatment operation are automatically adjusted according to a time input by a user.

The objects of the present invention are not limited to the above-mentioned objects and other objects that have not been mentioned above will become evident to those skilled in the art from the following description.

To achieve the above objects, there is provided a washing machine according to an exemplary embodiment of the present invention, executing a laundry treatment operation including a wash to remove contaminant from laundry by applying detergent to the laundry, a rinse to remove the detergent from the laundry, and a spin-dry to remove water from the laundry by rotating a washing tub containing the laundry at a high speed, the washing machine including a time setting unit configured to set an operation time, and a controller configured to control the laundry treatment operation so as to be terminated before expiration of the operating time by adjusting at least one of a level of water supplied to the washing tub to execute at least one of the wash and the rinse, a number of times of execution of the rinse and an execution time of the spin-dry, according to the operation time set through the time setting unit.

The washing machine may further include a laundry amount setting unit configured to set an amount of the laundry, wherein the controller may set a range of a time, inputtable through the time setting unit, according to the amount of the laundry set through the laundry amount setting unit.

The controller may increase lower and upper limits of the inputtable time, as the amount of the laundry set through the laundry amount setting unit increases.

The washing machine may further include a contamination degree setting unit configured to set a contamination degree, wherein the controller may set a range of a time, inputtable through the time setting unit, according to the contamination degree set through the contamination degree setting unit.

The controller may increase lower and upper limits of the inputtable time, as the contamination degree set through the contamination degree setting unit increases.

The washing machine may further include a water level setting unit configured to set a water supply level, wherein the controller may set the range of a time, inputtable through the time setting unit, according to the water supply level set through the water level setting unit.

The controller may increase lower and upper limits of the inputtable time, as the water supply level set through the water level setting unit increases.

The controller may adjust a gradient of acceleration of the washing tub during the spin-dry according to the operation time set through the time setting unit.

The controller may set the gradient of acceleration to be increased, as the operation time set through the time setting unit decreases.

The controller may adjust a rotation speed maintained by the washing tub during the spin-dry according to the operation time set through the time setting unit.

The controller may increase the rotation speed maintained by the washing tub during the spin-dry, as the operation time set through the time setting unit decreases.

The controller may adjust a time taken for the washing tub to be rotated while maintaining a predetermined spin-drying rotation speed during the spin-dry according to the operation time set through the time setting unit.

The controller may decrease the time taken for the washing tub to be rotated while maintaining the spin-drying rotation speed, as the operation time set through the time setting unit decreases.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENTS

The advantages and features of the present invention, and the way of attaining the same, will become apparent with reference to embodiments described below in conjunction with the accompanying drawings. Reference will now be made in detail to the preferred embodiments of the present invention, examples of which are illustrated in the accompanying drawings. Wherever possible, the same reference numbers will be used throughout the drawings to refer to the same or like parts.

Figure 1:
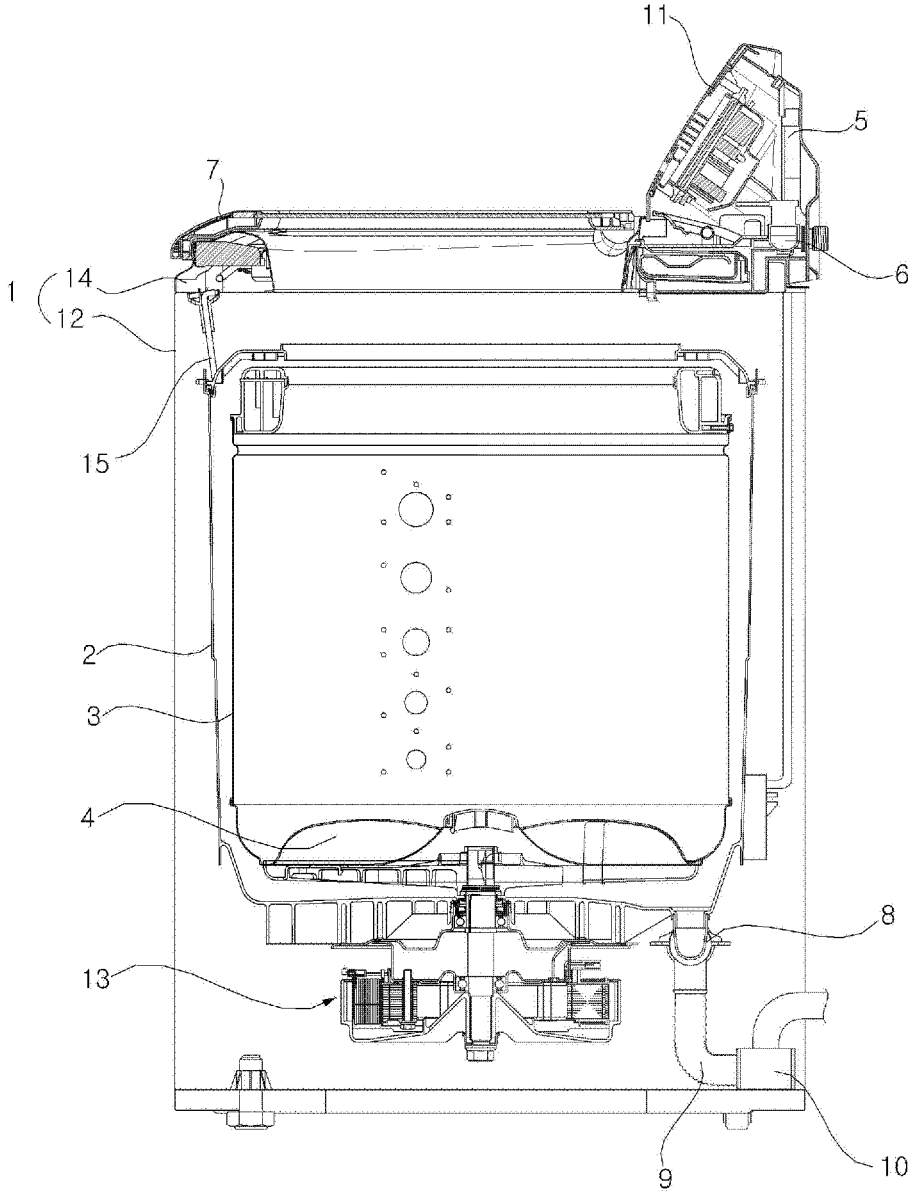
FIG. 1 is a cross-sectional view of a washing machine in accordance with one embodiment of the present invention.
Figure 2:
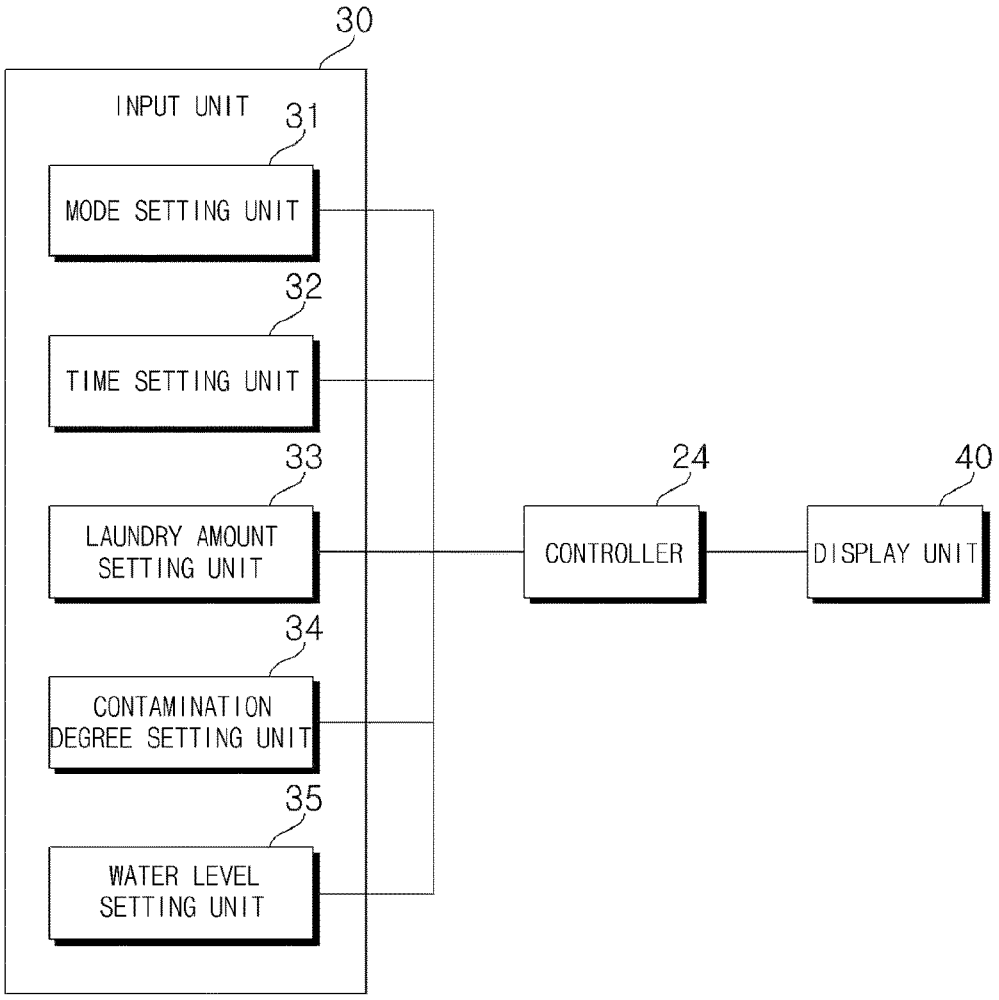
FIGS. 2 and 3 are block diagrams illustrating control relations among main elements of the washing machine shown in FIG. 1.
Figure 3:
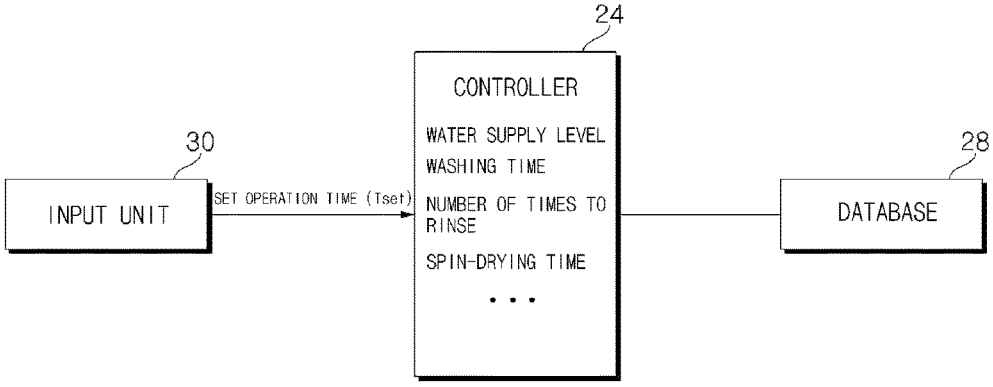
Figure 4:
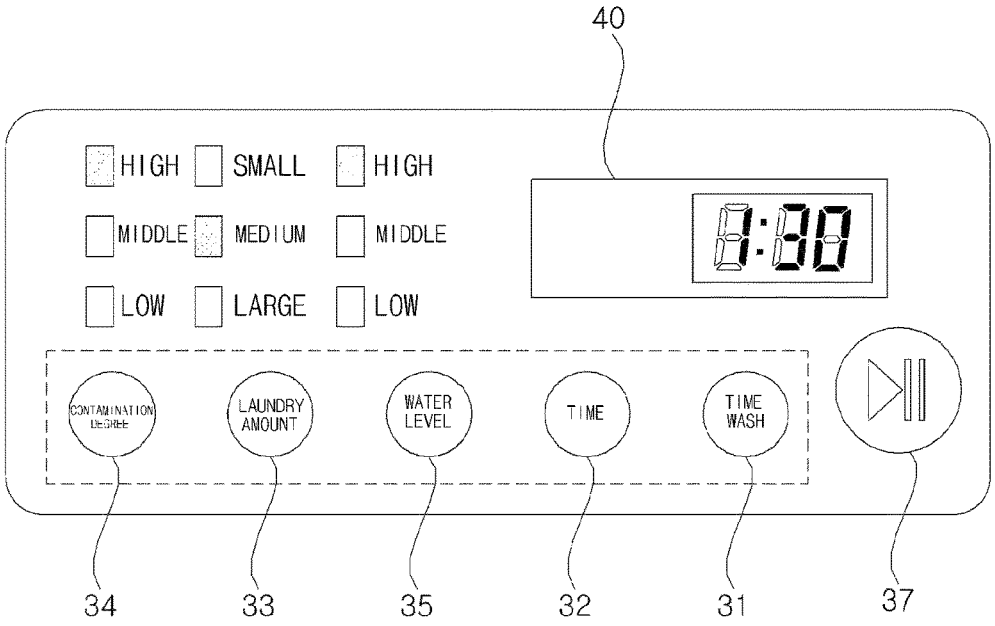
FIG. 4 is a view illustrating a control panel in accordance with one embodiment of the present invention.

FIG. 1 is a cross-sectional view of a washing machine in accordance with one embodiment of the present invention. FIGS. 2 and 3 are block diagrams illustrating control relations among main elements of the washing machine shown in FIG. 1. FIG. 4 is a view illustrating a control panel in accordance with one embodiment of the present invention.

A washing machine in accordance with one embodiment of the present invention may execute a laundry treatment operation including a wash in which a detergent is applied to the laundry such that contaminants is removed from laundry, a rinse in which the detergent is removed from the laundry, and a spin-dry in which water is removed from the laundry by rotating a washing tub containing the laundry at a high speed. The laundry treatment operation may be executed based on various setting items input through an input unit 30, which will be described later. Hereinafter, a time from when the laundry treatment operation is initiated till when the laundry treatment operation is terminated will be referred to as an operation time.

With reference to FIGS. 1 and 2, the washing machine in accordance with one embodiment of the present invention may include a casing 1 forming the external appearance of the washing machine and a control panel 11 disposed on the casing 1. The control panel 11 may include the input unit 30 to receive various control commands from a user and a display unit 40 to display information regarding the operating state of the washing machine. A door 7 to open or close an opening (not shown) through which laundry enters may be provided on the casing 1 so as to be pivotable about the casing 1.

An outer tub 2 to contain washing water may be suspended within the casing 1 by a support rod 15 and a washing tub 3 to receive laundry may be provided within the outer tub 2 so as to be rotatable about a vertical axis. A pulsator 4 is provided on the bottom of the washing tub 3 so as to be rotatable and a plurality of holes to pass washing water is formed through the washing tub 3.

The casing 1 may include a cabinet 12 with an opened upper surface, and a top cover 14 provided at the opened upper surface. The top cover 14 has an opening formed at the center thereof so that laundry may be put into the washing tub 2 through the opening.

The support rod 15 is extended in the longitudinal direction, one end of the support rod 15 is connected to the casing 1 and a suspension (not shown) to elastically support the outer tub 2 is provided at the other end of the support rod 15. One end of the support rod 15 may be connected to any one of the cabinet 12 and the top cover 14, and the cabinet 12 or the top cover 14 may include a connection unit (not shown) to which the support rod 15 is pivotally connected.

A supply water flow path 5 is connected to an external water source, such as a faucet, and guides water to the inside of the outer tub 2 and/or the washing tub 3. A water supply valve 6 to control a water flow may be provided on the water supply path 5. A detergent box 16 to receive detergent may be provided on the top cover 14. When water is supplied to perform wash, washing water guided along the water supply path 5 may be input to the inside of the washing tub 3 via the detergent box 16.

A drain path 9 serves to drain washing water within the outer tub 2. A drain valve 8 to control a water flow through the drain path 9 and a drain pump 10 to discharge washing water in the drain path 9 to the outside of the washing machine. A drive unit 13 rotates the washing tub 3 and/or the pulsator 4. The drive unit 13 may include a rotating motor and a clutch to transmit rotating force of the motor selectively to the washing tub 3 or the pulsator 4. The washing tub 3 and the pulsator 4 may be integrally rotated or the pulsator 4 alone may be rotated in the stopped state of the washing tub 3 by the switch operation of the clutch.

With reference to FIG. 2, the input unit 30 may include a mode setting unit 31, a time setting unit 32, a laundry amount setting unit 33, a contamination degree setting unit 34 and/or a water level setting unit 35. Various setting items input through these respective elements may be input to the controller 24 through electrical signals, and the controller 24 may electrically control various elements forming the washing machine according to the input setting items.

A user may set an operation time through the time setting unit 32. The controller 24 may adjust at least one of a level of water to be supplied to the inside of the washing tub 3 (hereinafter, referred to as a "water supply level") so as to execute at least one of wash and rinse, a number of times to perform wash or rinse and an execution time (Ts) of the spin-dry and, according to the operation time (Tset; hereinafter, referred to as a "set operation time") set through the time setting unit 32 and thus control the laundry treatment operation to be terminated before the set operation time (Tset) expires. Such control carried by the controller 24 is performed, when the user selects a specific mode (hereinafter, referred to as a "time wash mode") through the mode setting unit 31.

The user may set the amount of laundry (hereinafter, referred to as a "laundry amount") through the laundry amount setting unit 33. The set laundry amount may be displayed through the display unit 40 or indicator lights provided on the control panel 11 (with reference to FIG. 4).

The controller 24 may set a range of time, which may be input through the time setting unit 32, according to the laundry amount set through the laundry amount setting unit 33. For example, Table 1 below exemplarily states, if "small amount", "medium amount" or "large amount" may be set as the laundry amount through the laundry amount setting unit 33, ranges of time which may be set so as to correspond to the respective laundry amounts.

TABLE 1

| Laundry Amount | Operation time (Tset) which may be Input |
|---|---|
| Small | 20~40 mins. |
| Medium | 50~80 mins. |
| Large | 90~120 mins. |

As known from Table 1, the controller 24 may set a range of time, which may be input through the time setting unit 32, according to the laundry amount set through the laundry amount setting unit 33. Particularly, as the laundry amount set through the laundry amount setting unit 32 increases, the controller 24 may increase the upper and lower limits of the range of time, which may be input through the time setting unit 32. For example, in Table 1, if "medium amount" is set as the laundry amount, an operation time between 50 mins. (the lower limit) and 80 mins. (the upper limit) may be input and, if "large amount" is set as the laundry amount, an operation time between 90 mins. (the lower limit) and 120 mins. (the upper limit) may be input, i.e., the operation time for the large amount may be increased, as compared to the operation time for the small amount or the medium amount.

The controller 24 may control the display unit 40 so as to display an operation time which may be set at present and, whenever the time setting unit 32 is selected, the time displayed through the display unit 40 may be varied. For example, if "large amount" is selected as the laundry amount, the display unit 40 displays the lower limit (90 mins., 1:30) of the time which may be selected as an initial value and, whenever the time setting unit 32 is selected, the time increases by 10 mins. Then, after the time reaches the upper limit (120 mins., 2:00), the time may return to the initial value. When the user confirms the time through the display unit and then selects a specific key (for example, an operation/stop key 37) provided through the input unit 30, the time displayed on the display unit 40 is set as an operation time and the laundry treatment operation is executed so as to be completed within the set operation time (Tset) under the control of the controller 24.

The user may set the contamination degree of laundry through the contamination degree setting unit 34. The contamination degree set through the contamination degree setting unit 34 may be displayed through the display unit 40 or indicator lights provided on the control panel 11 (FIG. 4 exemplarily illustrates display of three contamination degrees including "high", "middle" and "low").

The controller 24 may set a range of time, which may input through the time setting unit 32, according to the contamination degree set through the contamination degree setting unit 34. Particularly, as the contamination degree set through the contamination degree setting unit 34 increases, the controller 24 may increase the upper and lower limits of the range of time which may be input through the time setting unit 32.

Table 2 below exemplarily states, if "high", "middle" or "low" may be set as the contamination degree through the contamination degree setting unit 34, ranges of time which may be set so as to correspond to the respective contamination degrees.

TABLE 2

| Contamination degree | Operation time (Tset) which may be input |
|---|---|
| High | 20~40 mins. |
| Middle | 50~80 mins. |
| Low | 90~120 mins. |

In the same manner as the above description with reference to Table 1, the controller 24 may control the display unit 40 so as to display an operation time which may be set at present and, whenever the time setting unit 32 is selected, the time displayed through the display unit 40 may be varied. When a specific key (for example, the operation/stop key 37) provided through the input unit 30 is selected, the time displayed on the display unit 40 is set as an operation time and the laundry treatment operation is executed so as to be completed within the set operation time (Tset) under the control of the controller 24.

The user may set a water supply level through the water level setting unit 35. The water supply level set through the water level setting unit 35 may be displayed through the display unit 40 or indicator lights provided on the control panel 11 (with reference to FIG. 4).

The controller 24 may set a range of time, which may input through the time setting unit 32, according to the water supply level set through the water level setting unit 35. Particularly, as the water supply level set through the water level setting unit 35 increases, the controller 24 may increase the upper and lower limits of the range of time which may be input through the time setting unit 32.

Table 3 below exemplarily states, if "high", "middle" or "low" may be set as the water supply level through the water level setting unit 35, ranges of time which may be set so as to correspond to the respective water levels.

TABLE 3

| Water supply level | Operation time (Tset) which may be input |
|---|---|
| Low | 20~40 mins. |
| Middle | 50~80 mins. |
| High | 90~120 mins. |

In the same manner as the above description with reference to Table 1, the controller 24 may control the display unit 40 so as to display an operation time which may be set at present and, whenever the time setting unit 32 is selected, the time displayed through the display unit 40 may be varied. When a specific key (for example, the operation/stop key 37) provided through the input unit 30 is selected, the time displayed on the display unit 40 is set as an operation time and the laundry treatment operation is executed so as to be completed within the set operation time (Tset) under the control of the controller 24.

Hereinafter, if the operation time is set as described above, setting or changing of the detailed configurations of laundry treatment operation according to the set operation time (Tset) will be described.

The controller 24 may adjust a washing time according to the set operation time (Tset). Washing may include rotations of the pulsator 4 or the washing tub 3 according to various predetermined patterns, and the controller 24 may adjust the execution time of each rotation according to the set operation time (Tset). Particularly, as the set operation time (Tset) decreases, the washing time may be set to decrease.

The controller 24 may adjust the gradient of acceleration of the washing tub 3 according to the set operation time (Tset) during the spin-dry. In the spin-dry, the washing tub 3 is accelerated up to a predetermined spin-drying rotation speed and then rotated for a designated time while maintaining the spin-drying rotation speed. Here, the gradient of acceleration of the washing tub 3 up to the spin-drying rotation speed (hereinafter, referred to as a "gradient of acceleration") may be adjusted according to the set operation time (Tset). By varying the gradient of acceleration, a time taken for the washing tub 3 to reach the spin-drying rotation speed may be adjusted and, thus, the overall laundry treatment operation may be terminated within the set operation time (Tset). Particularly, the controller 24 may set the gradient of acceleration to have a greater value, as the set operation time (Tset) decreases. That is, the controller 24 shortens a time taken for the washing tub 3 to be accelerated up to the spin-drying rotation speed, as the set operation time (Tset) decreases.

The controller 24 may adjust a rotation speed which the washing tub 3 maintains during the spin-dry (i.e., the spin-drying rotation speed) according to the set operation time (Tset). Particularly, as the set operation time (Tset) decreases, the controller 24 may increase the spin-drying rotation speed and, thus, laundry may be rapidly spin-dried.

The controller 24 may adjust a time for which the washing tub 3 is rotated while maintaining the spin-drying rotation speed (hereinafter, referred to as a "maintenance time") during the spin-dry. Particularly, the maintenance time may decrease, as the set operation time (Tset) decreases.

The washing machine may include a water level sensor (not shown) to sense a water level within the outer tub 2. In this case, the controller 24 sets a water supply level according to the operation time set through the time setting unit 32 and opens the water supply valve 6 so as to supply water for the wash or rinse. While water supply is carried out, the water sensor may continue to sense the water level and, upon judging that the sensed water level reaches a set water supply level, the controller 24 may close the water supply valve 6. The controller 24 may set the water supply level to be lower, as the set operation time (Tset) decreases. The reason for this is to reduce a time taken to perform water supply. Such a method of adjusting the water supply level according to the set operation time (Tset) may allow the water supply level to be re-adjusted according to the set operation time (Tset) even in the case in which the water supply level is automatically determined according to a laundry amount.

The controller 24 may adjust a number of times of execution of the rinse according to the set operation time (Tset). The number of times of execution of the rinse may decrease, as the set operation time (Tset) decreases.

As described above, it may be understood that, through adjustment of a water supply level, a washing time, the number of times of rinsing, a spin-drying time, etc. by the controller 24, values pre-stored in a database 28 are changed to other values according to a set operation time (Tset) and then the changed values are stored in the database 28.

As apparent from the above description, a washing machine in accordance with the present invention may terminate a laundry treatment operation within a time set by a user and increase user convenience. Further, by automatically adjusting various variables, the laundry treatment operation may be terminated within a time input by the user.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine for executing a laundry treatment operation including a wash, a rinse, and a spin-dry, the washing machine comprising:

a time setting unit to set an operation time;

a water level setting unit to set a water supply level; and a controller to control the laundry treatment operation, so as to be completed before expiration of the operation time set by the time setting unit, by adjusting at least one of:

a level of water supplied to a washing tub for at least one of the wash and the rinse, a number of times the rinse is executed, and an execution time of the spin-dry, wherein the controller provides a range of operation times, selectable through the time setting unit, based on the water supply level set through the water level setting unit, wherein the controller adjusts an acceleration gradient of the washing tub during the spin-dry according to the operation time set through the time setting unit, and wherein the controller increases the acceleration gradient of the washing tub, as the operation time set through the time setting unit decreases.

2. The washing machine of claim 1, further comprising:

a laundry amount setting unit to set an amount of laundry, wherein the controller provides a range of operation times, selectable through the time setting unit, based on the amount of laundry set through the laundry amount setting unit.

3. The washing machine of claim 2, wherein the controller increases a lower and an upper limit of the range of operation times, as the amount of laundry set through the laundry amount setting unit increases.

4. The washing machine of claim 1, further comprising:

a contamination degree setting unit to set a contamination degree, wherein the controller provides a range of operation times, selectable through the time setting unit, based on the contamination degree set through the contamination degree setting unit.

5. The washing machine of claim 4, wherein the controller increases a lower and an upper limit of the range of operation times, as the contamination degree set through the contamination degree setting unit increases.

6. The washing machine of claim 1, wherein the controller increases a lower and an upper limit of the range of operation times, as the water supply level set through the water level setting unit increases.

7. The washing machine of claim 1, wherein the controller adjusts a rotation speed maintained by the washing tub during the spin-dry according to the operation time set through the time setting unit.

8. The washing machine of claim 7, wherein the controller increases the rotation speed maintained by the washing tub during the spin-dry, as the operation time set through the time setting unit decreases.

9. The washing machine of claim 1, wherein the controller adjusts a time taken for the washing tub to be rotated while maintaining a predetermined spin-drying rotation speed during the spin-dry according to the operation time set through the time setting unit.

10. The washing machine of to claim 9, wherein the controller decreases the time taken for the washing tub to be rotated while maintaining the spin-drying rotation speed, as the operation time set through the time setting unit decreases.

11. The washing machine of claim 1, wherein the wash removes contaminants from laundry by applying detergent to the laundry, the rinse removes detergent from the laundry, and the spin-dry removes water from the laundry by rotating the washing tub containing the laundry at a high speed.

12. The washing machine of claim 1, wherein the controller controls the laundry treatment operation so as to be completed before expiration of the set operation time.

13. The washing machine of claim 1, wherein the selected operation time is displayed on a display unit.

* * * * *